United States Patent [19]

Rodewald et al.

[11] 3,941,124

[45] Mar. 2, 1976

[54] RECIRCULATING BREATHING APPARATUS AND METHOD

[76] Inventors: Newell C. Rodewald, c/o Frank Wattles, P.O. Box 1514, Manhattan Beach, Calif. 90266; Jerry E. Sinor, 6667 Birdcliff Way, Longmont, Colo. 80501

[22] Filed: Jan. 21, 1969

[21] Appl. No.: 792,874

[52] U.S. Cl. ..... 128/142; 62/50; 128/203

[51] Int. Cl.[2] ..... A62B 7/06

[58] Field of Search ..... 128/140, 145, 147, 142.2, 128/142.3, 142.4, 142, 203, 188; 62/50–52, 259

[56] References Cited

UNITED STATES PATENTS

| | | | |
|---|---|---|---|
| 3,221,733 | 12/1965 | Beasley | 128/145.6 |
| 3,316,905 | 5/1967 | Seeler | 128/147 |
| 3,366,107 | 1/1968 | Frantom | 128/142.2 |
| 3,807,396 | 4/1974 | Fischell | 128/142 |

FOREIGN PATENTS OR APPLICATIONS

| | | | |
|---|---|---|---|
| 816,874 | 7/1959 | United Kingdom | 128/203 |

*Primary Examiner*—Kyle L. Howell
*Attorney, Agent, or Firm*—Frank Wattles

[57] ABSTRACT

A process for supplying the proper amount of oxygen in a breathing gas mixture of at least one inert gas for use at any pressure by passing the gas mixture through the liquid phase of a cryogenic liquid-vapor system containing oxygen and thereby saturating with oxygen the gas mixture at the system pressure. The saturation concentration of oxygen in the gas stream is controlled to the desired oxygen partial pressure substantially independent of the total pressure of gas mixture by controlling the temperature of the two-phase cryogenic system.

A device embodying the process includes oxygen in liquid-vapor form within a container to which are connected gas conduits, one for delivering the saturated breathing gas mixture to a user and the other for returning the exhaled gas to the container. A filter in the return conduit extracts carbon dioxide and water vapor. The return gas is cooled to the cryogenic temperature and the saturated gas is heated to breathing temperature by a heat exchanger thermally connecting the two conduits. The two-phase system is maintained at the proper constant temperature by submerging the container in a tank of liquid nitrogen and allowing the nitrogen to boil-off at a certain pressure. A supply of inert gas is stored under high pressure in the container. A regulator determines total pressure requirements for the user and releases sufficient inert gas through the liquid oxygen to maintain required total pressure.

15 Claims, 7 Drawing Figures

Newell C. Rodewald
Jerry E. Sinor
INVENTORS

BY Frank Wattles

ATTORNEY

Newell C. Rodewald
Jerry E. Sinor
INVENTORS

BY Frank Wattles
ATTORNEY

Newell C. Rodewald
Jerry E. Sinor
INVENTORS

BY Frank Wattles

ATTORNEY

RECIRCULATING BREATHING APPARATUS AND METHOD

BACKGROUND OF THE INVENTION

1. Field of the Invention

Recirculation breathing systems and more particularly a process and apparatus for supplying a variable and controlled composition of breathable gas mixture through cryogenic oxygen to a user and recirculating the exhaled gas through the cryogenic oxygen.

2. Background of the prior art

A large number of different types of equipment have been developed to maintain the oxygen content of a gaseous body that is being breathed by a human being. The types of equipment are commonly categorized according to the purpose to which the life support system is directed, including such categories for equipment as hard-hat deep-sea diving, skin diving, high altitude aerospace and submarine. Within each of these categories there has been developed different equipment to meet particular requirements of life-support, but each has the same design requirement to maximize the period during which a human being is supported while maintaining safety measures and economies.

Exposure to a gaseous body of pure oxygen is dangerous. There is danger of flash explosion or fire. The toxic effect of oxygen in high concentrations and pressures produces oxygen poisoning of the user. A deficiency of oxygen produces hypoxia which obviously can result in fatigue or death. Exposure to a gaseous mixture of oxygen and an inert gas or air poses little or no danger of flash explosion or fire, but the oxygen must be maintained at a certain concentration and pressure to avoid oxygen poisoning and hypoxia. Furthermore, the inert gas may have deleterious effects. Nitrogen at high pressures produces nitrogen narcosis and for that reason the most commonly used breathing mixture at high pressures is helium and oxygen.

Inert gases, particularly helium, are expensive. An open-circuit system in which the exhaled breathing mixture is vented requires large supplies of gas and heavy and expensive storage equipment which limits the support time, range, and manueverability of the user. The solution is a closed circuit recirculation system which reuses the uncomsumed gases. This self-contained system can be lighter and simpler, giving the user more range and manueverability. The exhaled gas must be treated to remove carbon dioxide and water vapor which if breathed in sufficient quantities are harmful. Also, for a given ambient pressure upon the user, the breathing gas mixture must have approximately an equal total pressure with the partial pressure of oxygen maintained at approximately 3 p.s.i.a., the optimum breathing partial pressure, for long periods of life-support. For a varying ambient pressure the composition of the breathing gas mixture must be varied correspondingly. In the present art composition variation requires complex and expensive equipment to analyze the gas composition and to remix the gas to the desired concentration.

The length of life-support time is limited by the amount of gas the self-contained apparatus can store. Cryogenic storage of the gas provides increased storage capacity for a limted volume and avoids the disadvantage of storage of the gas at high pressures.

In summary, the maximization of user manueverability and life-support time as well as safety and realization of economies can best be achieved by a recirculatory system employing a breathing gas mixture of an inert gas and oxygen in which the gas is cryogenically stored and the composition of the mixture is varied according to user requirements. Patented devices and processes employing some, but not all, of these characteristics include:

U.S. Pat. No. 2,998,009 Breathing Apparatus
U.S. Pat. No. 3,016,053 Underwater Breathing Apparatus
U.S. Pat. No. 3,064,448 Air Conditioned Fuel Handling Suit
U.S. Pat. No. 3,366,107 Apparatus for Supplying Breathable Gas from Oxygen in Liquid Form The present invention employs all of the characteristics described above and in a unique process. The oxygen is replaced and maintained at approximately the optimum breathing partial pressure of 3 p.s.i.a. by passing the breathing gas mixture through the liquid phase of a cryogenic liquid-vapor system containing oxygen. The cryogenic fluid is maintained in a two-phase condition to insure a gas head and liquid storage and to produce the oxygen replacement in the gas stream at saturation concentration so that the 3 p.s.i.a. partial pressure of the oxygen in the resultant mixture remains substantially constant and independent of the total pressure of the breathing gas mixture. To maintain the cryogenic fluid in the proper liquid-vapor form the system is maintained at a certain temperature and pressure. As the total pressure of the breathing gas mixture in increased additional inert gas is deposited to constitute a larger percentage of the mixture. The concentration of oxygen will be automatically decreased to hold the oxygen partial pressure at 3 p.s.i.a. This automatically controlled composition of breathing gas mixture is particularly suited for human breathing under a wide range of environmental pressure conditions. The gas mixture is heated to breathing temperature and continuously delivered to the user. Upon recirculation of the exhaled gas, carbon dioxide and water vapor within the exhaled gas are frozen out upon contact with the cryogenic and the remaining gas again is bubbled through the liquid phase of the liquid-vapor cryogenic system. According to this invention no special gas analyzing equipment is required to obtain desired concentration of oxygen in a breathing gas mixture having at least one inert gas mixed with oxygen. The composition of the breathing gas can be varied continuously to supply the desired total pressure of gas and partial pressure of oxygen to a user experiencing a wide range of ambient pressure variations. The manueverability, life support time, and safety of the user are maintained in a simple, efficient and inexpensive device embodying the invention.

SUMMARY OF THE INVENTION

Briefly, the invention relates to a process and apparatus for automatically and continuously varying the composition of a breathable gas mixture containing at least one inert gas in proportion to the variation in ambient pressure upon a user to whom the gas mixture is delivered. According to the invention a breathable gas mixture is supplied to the user. The exhaled gas of the user is withdrawn, carbon dioxide and water vapor filtered therefrom and the filtered gas mixture decreased in temperature to a cryogenic temperature substantially the vapor pressure temperature of liquid oxygen corresponding to a determined partial pressure of oxygen in the breathable gas mixture. Simultaneously with the decreasing of temperature of the gas mixture, certain components of the gas mixture are removed by freezing out those components. The resultant gas mixture is brought in contact with a cryogenic liquid-vapor system containing oxygen to saturate the gas mixture in order to produce the determined partial pressure of oxygen substantially independent of the total pressure of breathable gas mixture. The cryogenic contacted gas mixture is heated to substantially the temperature at which the gas in breathed and the heated gas mixture is resupplied to the user. During cycling of the gas mixture from the user through the cryogenic liquid-vapor system and back to the user the composition of the gas mixture is varied by varying the quantity of inert gas within the breathable gas mixture to produce a total pressure of breathing gas mixture substantially equal to ambient pressure upon the user. Finally, during said cycling of the gas mixture the cryogenic liquid-vapor system is maintained at a constant temperature.

DESCRIPTION OF THE PREFERRED EMBODIMENTS

In order to understand the invention in more detail, it is necessary to discuss in general terms breathing gas mixture requirements in a life-support system for humans and phase behavior of breathing gas mixtures. As described above, for medical reasons the partial pressure of oxygen within the breathing gas mixture should be maintained constant at approximately 3 p.s.i.a. even though the total pressure of the mixture varies. The partial pressure of oxygen can be held constant by bubbling an inert gas carrier through the liquid phase of a cryogenic liquid-vapor system containing oxygen to saturate the gas mixture with oxygen at the system pressure.

Figure 1:
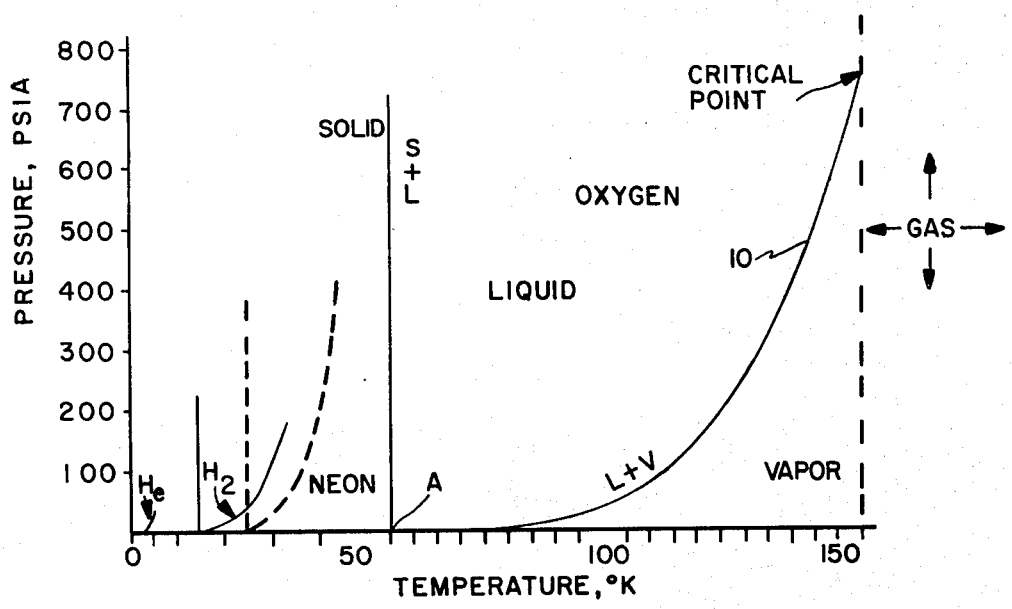
FIG. 1. Graphical representation of pressure-temperature relationships for oxygen, neon, hydrogen and helium.

A mixture comprises components or elements such as helium, neon, argon, and nitrogen. As illustrated in FIG. 1, each pure component typically has separate pressure and temperature ranges where the pure component exists as a liquid, a vapor, a gas, or a solid, which state is called a phase. Except for the gas phase, each of these phase regions is separated by a locus where the two phases coexist. The locus where liquid and vapor coexist is called the vapor-pressure curve. This curve ends at a point called the critical temperature, the highest temperature at which liquid phase can exist, and begins at a point A where liquid, vapor and solid coexist. For oxygen, the vapor-pressure curve 10 ranges from approximately 150° K and 750 p.s.i.a. to approximately 55° K and 0.0221 p.s.i.a. Therefore, for oxygen in liquid-vapor form, a given temperature will have one pressure of oxygen and a given pressure will have one temperature of oxygen. Oxygen in liquid-vapor form at a certain temperature will have a corresponding pressure, e.g. 3 p.s.i.a.

FIG. 1 illustrates as examples of inert gas characteristics the vapor pressure curves for helium, hydrogen and neon. The critical temperature of each component is reached at a temperature lower than the lowest temperature of the vapor pressure curve of oxygen. Inert gases having this characteristic of critical temperatures below temperatures on the vapor pressure curve of oxygen are good carriers because they remain in gas phase when passed through oxygen in liquid-vapor phase.

Figure 2:
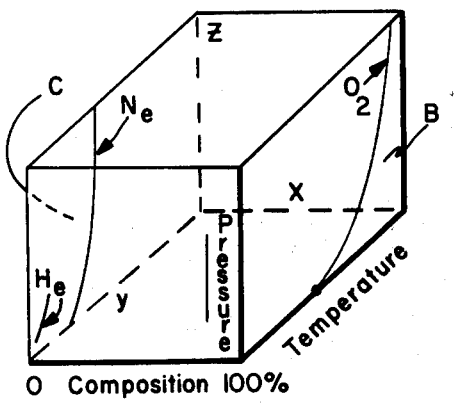
FIG. 2. Three-dimensional graphical representation of pressure-temperature-composition relationships for oxygen and neon or oxygen and helium.
Figure 3:
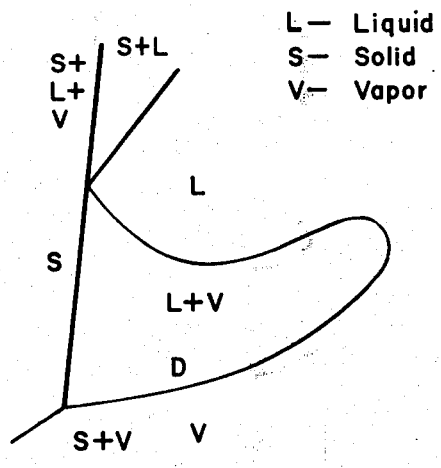
FIG. 3. Generalized graphical representation of pressure-temperature relationships for oxygen and one light gas selected from the group of helium, hydrogen and neon for a constant composition.
Figure 4:
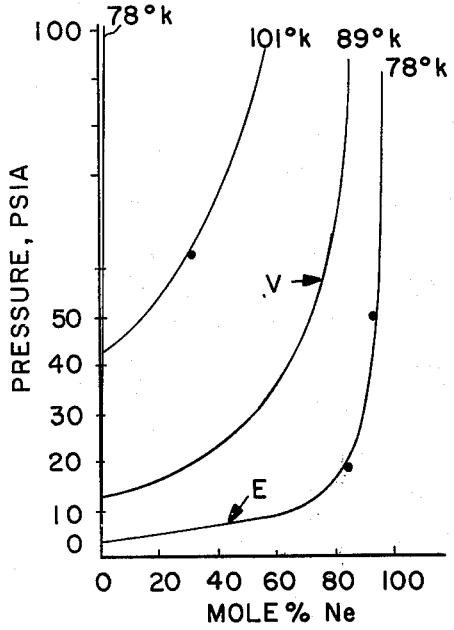
FIG. 4. Graphical representation of pressure-mole precentage of neon for a constant temperature.

When two pure components are mixed, composition becomes a variable in addition to pressure and temperature variables. FIG. 2 diagrammatically illustrates the relationship of composition, temperature and pressure of oxygen/helium mixture and oxygen/neon mixture on an x, y, z three dimensional diagram. The phase behavior is characterized by lines and surfaces within the cube. The vapor pressure curve of oxygen illustrated in FIG. 1 is illustrated again in FIG. 2 on one face B of the cube and the vapor pressure curves of helium and neon illustrated in FIG. 1 are illustrated similarly in FIG. 2 on the face C of the cube opposite the oxygen curve. The scale between pure components on face B and face C represents a mixture of varying concentration. FIG. 3 illustrates a slice of the cube of FIG. 2 for a mixture having a certain composition. The vapor pressure curve which was a line for the pure component, opens up into an area D for the mixture. FIG. 4 illustrates a slice of the cube of FIG. 2 for a neon/oxygen mixture having constant temperature and variable pressure and composition. Following the curve E representing a temperature 78° K, it is apparent that the concentration of neon in a neon/oxygen mixture varies proportionally to the total pressure and it will become apparent that the concentration of oxygen will vary in inverse relation to the variation of neon concentration with the partial pressure of the oxygen remaining at approximately 3 p.s.i.a.

Figure 5:
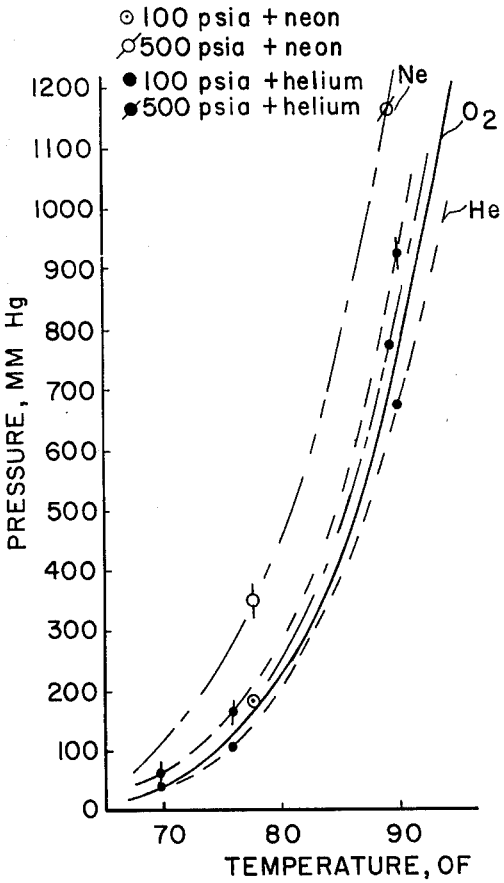
FIG. 5. Graphical representation of partial pressure of liquid oxygen and partial pressure of liquid oxygen with neon and helium, respectively added at selected pressures.

A slight shift of the partial pressure of oxygen occurs when the system total pressure is increased greatly. The curves of FIG. 5 illustrate the shift for helium and neon at total pressures of 100 p.s.i.a. and 500 p.s.i.a. It will be observed that the helium curve shifts a lesser amount from the oxygen curve than does the neon curve. Thus, under conditions of high total pressure and required constant partial pressure of oxygen, helium should be selected as the inert gas carrier. To further compensate for the shift in order to maintain the partial pressure of oxygen at substantially 3 p.s.i.a., the temperature of the cryogenic fluid can be charged so that when a breathing gas mixture containing an inert gas or gases is passed through the fluid the inert gas or gases acquires oxygen at a partial pressure of approximately 3 p.s.i.a. FIG. 5 illustrates a vapor pressure curve for liquid oxygen below one atmosphere pressure. The desired partial pressure of oxygen of 3 p.s.i.a. corresponds to a temperature of approximately 77.5° K on the oxygen curve of FIG. 5. Consequently, neon passed through oxygen in liquid-vapor form at a temperature of 77.5° K will acquire oxygen of a partial pressure of 3 p.s.i.a. and the oxygen partial pressure will not vary substantially as the system total pressure is varied over a wide range.

Figure 6:
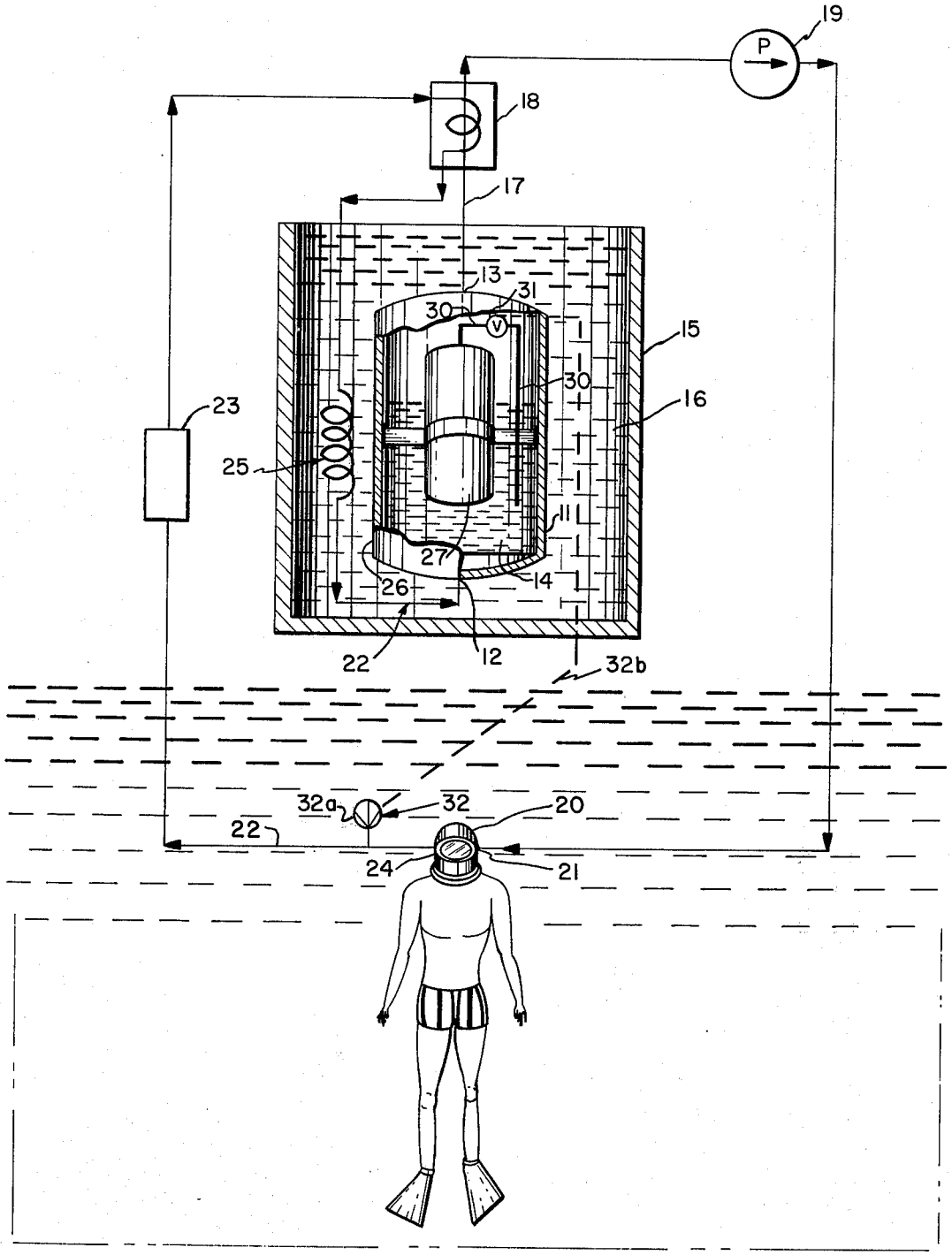
FIG. 6. Illustration of one preferred embodiment of the invention.

Referring to FIG. 6, one preferred embodiment of the invention is illustrated. Container 11 is a high pressure cryogenic tank having an inlet 12 for admitting the exhaled gas and an outlet 13 providing an exit for the oxygen-saturated breathing gas. A cryogenic fluid 14 within container 11 must exist in a liquid-vapor phase, the liquid being pure oxygen or a mixture of oxygen and inert gas or gases. To maintain fluid 14 in liquid-vapor phase, the temperature of fluid 14 must be maintained in the range between 50° K and 150° K as illustrated in FIG. 1. Tank 15 and liquid coolant 16 contained therein provide a means for maintaining the fluid temperature within the stated range. Container 11 is simply submerged in coolant 16 and fixedly mounted within tank 15. Coolant 16, for example liquid nitrogen, should have a boil-off temperature approximately equal to the desired temperature of fluid 14 and the ambient pressure at tank 15 should be maintained at a pressure designed to produce a desired boil-off temperature and, thereby, a desired cryogenic temperature. The means for maintaining the temperature of fluid 14 is not limited to the described method. Many known methods are available to maintain fluids at certain cryogenic temperatures and those methods are contemplated as equivalents in this invention. Inhale conduit 17 is connected at one end to outlet 13 and extends through heat exchanger 18 and pump 19 to the other end which is adapted to be connected to the user's breathing apparatus 20 at 21. A leakproof passage is provided by conduit 17 for delivering oxygen-saturated breathing gas from container 11 to apparatus 20. Where the economies of a heat exchanger are not required, any heating means may be substituted to raise the temperature of the breathable gas to substantially the temperature at which the gas is to be breathed. Pump 19 provides a means for circulating the breathable gas from container 11 to the user at apparatus 20. Occasionally a pump will not be required and may be omitted because the lung power of the user will provide sufficient circulation. Exhale conduit 22 is connected at one end to the inlet 12 and extends through heat exchanger 18 and exhale filter 23 to the other end which is adapted to be connected to apparatus 20 at 24. A leakproof passage is provided by conduit 22 for withdrawing exhaled gas from apparatus 20 and depositing the gas into container 11. Gas within conduit 22 provides the heat within heat exchanger 18 which is transferred to conduit 17 and in turn conduit 22 is cooled by the refrigeration of the gas in conduit 17. As previously described, heat exchanger 18 may be omitted. Exhale filter 23 is any presently known device for removing components from the exhaled gas which are undesirable for breathing. Commonly, the components removed will be carbon dioxide and water vapor. Filter 23 provides filtering of carbon dioxide and water vapor additional to the filter process inherent in the proximity to the exhaled gas of the coolant 16 where those components are frozen out. In the event such additional filtering is not required, this invention contemplates omission of filter 23. Another optional feature is a portion of conduit 22 located within coolant 16 forming a coil 25. Coil 25 provides additional heat exchange with coolant 16 to insure gas entering inlet 12 is more nearly the temperature of fluid 14. Inert gas bottle 26 contains inert gas 27 and provides a source of gas supply for supplying replacement gas to the breathing gas mixture. Gas 27 may be a pure inert gas or a gaseous mixture and is stored in bottle 26 under high pressure. An outlet passage 30 from bottle 26 extends below the surface of fluid 14 and provides a means of gas release below the fluid surface to allow gas 27 to be released into fluid 14 and to bubble therethrough. A control valve 31 is interconnected in passage 30. Regulator 32 comprises any commonly known sensor **32*a* for sensing ambient pressure and means 32*b* for communication pressure data for opening and closing valve 31 in accordance with ambient pressure. The valve gate is opened wider for increasing ambient pressure and correspondingly closed for decreasing pressure. Valve 31 will remain open for a time period sufficient to adjust the pressure of the breathable gas mixture to be substantially equal to the ambient pressure and upon equalized pressure being reached valve 31 is closed. The total pressure is decreased by venting the gas from apparatus 20. To facilitate determination of ambient pressure, the sensor 32*a* should be located proximate to apparatus 20.**

Figure 7:
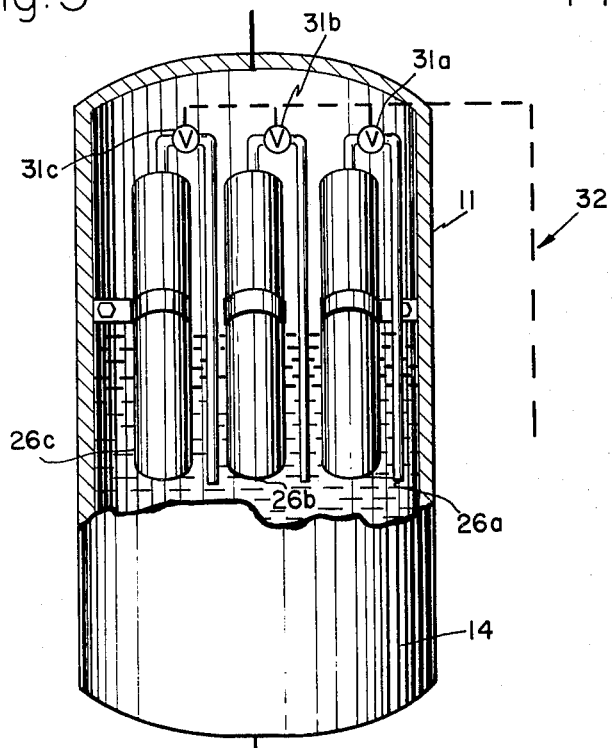
FIG. 7. Illustration of a subcombination optionally included in the embodiment of FIG. 6 to form another preferred embodiment of the invention.

As illustrated in FIG. 7, this invention contemplates an alternative embodiment wherein a plurality of inert gas bottles **26*a*, 26*b*, 26*c*, each containing a selected inert gas or gaseous mixture under high pressure and each stored in container 11 within fluid 14 or under similar temperature conditions. Each gas bottle has a valve release device 31*a*, 31*b*, 31*c* identical to valve 31 as described for bottle 26. Valves 31*a*, 31*b*, 31*c* are each connected to sensor 31*a* by communication means 32*b* to be respectively and independently operated similar to the valve 31 and regulator 32. According to this embodiment, not only a variation of the ratio of a certain inert gas or gas mixture to oxygen is possible, but also a variation of the inert gases used within the breathable gas mixture. Also, this invention contemplates omission of regulator 32** where automatic control of the composition of the breathing gas mixture is not required, e.g. where the composition requirements are predetermined from known ambient pressure data.

According to the operation of the apparatus and process, breathable gas breathed by the user in the life support apparatus 20 is withdrawn as exhaled gas through exhale conduit 22. Undesirable components, e.g. carbon dioxide and/or water vapor, are removed from the exhaled gas at filter 23, or in the event filter 23 is omitted, upon contact with coolant 16. The exhaled gas is passed through heat exchanger 18 where the heat of the exhaled gas is transferred to the inhale conduit 17 and the breathable gas. The cooled exhaled gas passes through coil 25 submerged in coolant 16 and is cooled to substantially the temperature of fluid 14. The temperature of the fluid 14 is maintained in the desired temperature range by boiling-off coolant 16 at a selected pressure. The cooled exhaled gas enters container 11 at inlet 12 and bubbles through fluid 14 saturating the gas with oxygen at a partial pressure suitable for breathing. The pressure of the breathing gas is varied by the operation of valve 31 which opens for sufficient time periods to deposit sufficient gas from bottle 26 into fluid 14 to adjust the pressure of the breathing gas to substantially equal the ambient pressure of the breathing gas to substantially equal the ambient pressure upon the user at apparatus 20. Valve 31 is automatically adjusted to the pressure detected at the sensor 32*a* by communication means 32*b*. The oxygen saturated breathable gas passes through outlet 13 into heat exchanger 18 where the gas is increased in temperature to substantially the safe breathing temperature. The breathable gas is circulated in the closed loop through pump 19 and delivered to the user at apparatus 20. Total pressure is decreased by venting the gas from apparatus 20.

As previously described, the novelty of this invention lies principally in the method of passing gas through a cryogenic fluid in liquid-vapor form to produce a breathable gas mixture having substantially constant partial pressure of oxygen for variable total pressures of breathing gas and delivering the breathable gas to a life-support system. To achieve this purpose certain embodiments of the invention have been described in detail herein and the accompanying drawings. It will be evident that various additional modifications are possible in the arrangement and construction of its components without departing from the scope of the invention. It will be appreciated that the applications of this invention are numerous including but not limited to life-support in deep-sea diving, skin diving, aerospace and orbital flights and mining.

We claim:

1. Apparatus for supplying a variable, controlled composition of a breathable gas mixture through oxygen in liquid-vapor form to a ventable breathing means at a variable ambient pressure, said apparatus comprising:

a container (for the oxygen in liquid-vapor form) having an inlet and an outlet and adapted to hold oxygen in liquid-vapor form, said inlet located below the normal surface level of the liquid oxygen and said outlet located above the normal surface level of the liquid oxygen;

an inhale conduit at one end connected to the container outlet and at the other end adapted to be connected to the breathing means;

an exhale conduit at one end connected to the container inlet and at the other end adapted to be connected to the breathing means thereby forming a loop wherein gas exhaled by a user at the breathing means passes through the exhale conduit to the container where poisonous components of the gas are frozen out and the remaining gas bubbles through the oxygen in liquid-vapor form to replace consumed oxygen and the resultant gas is supplied to the user through the inhale conduit; and means for heating the gas in the inhale conduit to substantially the temperature at which the gas is breathed.

2. Apparatus as recited in claim 1 and further comprising:

an exhale filter interconnected in flow communication in the exhale conduit for extracting components of the exhaled gas undesirable for breathing.

3. Apparatus as recited in claim 2 and further comprising:

a pump in the inhale conduit for circulating the flow of resultant gas through the inhale conduit to the breathing means.

4. Apparatus as recited in claim 3 and further comprising:

means for maintaining substantially constant the temperature of the oxygen within the container.

5. Apparatus as recited in claim 1 and further comprising:

means for cooling the exhaled gas to substantially the temperature of the oxygen in liquid-vapor form.

6. Apparatus as recited in claim 5 wherein:

the heating means and cooling means combine to form a heat exchanger thermally connecting the exhale conduit with the inhale conduit, said heat exchanger having a condensor for removal of carbon dioxide and water vapor from the exhaled gas.

7. Apparatus as recited in claim 5 and further comprising:

an exhale filter interconnected in flow communication in the exhale conduit for extracting components of the exhaled gas undesirable for breathing.

8. Apparatus as recited in claim 7 and further comprising:

a pump in the inhale conduit for circulating the flow of resultant gas through the inhale conduit to the breathing means.

9. Apparatus as recited in claim 8 and further comprising:

means for maintaining substantially constant the temperature of the oxygen within the container.

10. Apparatus as recited in claim 9 and further comprising:

a source of gas supply for supplying replacement to gas to the loop.

11. Apparatus as recited in claim 10 and further comprising:

a regulator adapted to determine ambient pressure upon the user and to supply a quantity of gas from the gas supply source sufficient to adjust the total pressure of the breathable gas mixture to substantially the ambient pressure upon the user.

12. Apparatus as recited in claim 11 wherein:

the exhale filter is adapted to extract carbon dioxide and water vapor.

13. Apparatus as recited in claim 12 wherein the oxygen temperature maintenance means comprises:

a tank adapted to receive therein the container; and liquid nitrogen within the tank and into which the container of oxygen in liquid-vapor form is submerged, the liquid nitrogen maintained at substantially constant pressure and allowed to boil off at a predetermined temperature.

14. Apparatus as recited in claim 13 wherein the source of replacement gas contains inert gas.

15. Apparatus as recited in claim 14 wherein the source of replacement gas comprises:

at least one inert gas bottle located within the container and maintained at the temperature of the oxygen in liquid-vapor form, said bottle adapted to supply replacement inert gas into the container so that the inert gas will bubble through the oxygen in liquid-vapor form.

* * * * *